US008378586B2

(12) United States Patent
Peker et al.

(10) Patent No.: US 8,378,586 B2
(45) Date of Patent: Feb. 19, 2013

(54) DISTRIBUTED ARCHITECTURE VOLTAGE CONTROLLED BACKLIGHT DRIVER

(75) Inventors: Arkadiy Peker, Glen Cove, NY (US); Dror Korcharz, Bat Yam (IL); Shawn Anthony Fahrenbruch, Fresno, CA (US)

(73) Assignee: Microsemi Corporation, Alisa Viejo, CA (US)

( * ) Notice: Subject to any disclaimer, the term of this patent is extended or adjusted under 35 U.S.C. 154(b) by 130 days.

(21) Appl. No.: 12/895,875

(22) Filed: Oct. 1, 2010

(65) Prior Publication Data

US 2011/0080117 A1 Apr. 7, 2011

Related U.S. Application Data

(60) Provisional application No. 61/247,584, filed on Oct. 1, 2009.

(51) Int. Cl.
*G05F 1/00* (2006.01)
*H05B 37/00* (2006.01)

(52) U.S. Cl. ..... 315/291; 315/312

(58) Field of Classification Search ..... 315/291, 315/307, 308, 312, 185 R, 185 S, 224
See application file for complete search history.

(56) References Cited

U.S. PATENT DOCUMENTS 6,963,175 B2 * 11/2005 Archenhold et al. ..... 315/291
7,317,403 B2 * 1/2008 Grootes et al. ..... 340/815.45
7,518,525 B2 * 4/2009 Chou ..... 340/815.45
7,550,935 B2 * 6/2009 Lys et al. ..... 315/318
7,825,610 B2 * 11/2010 Zhao et al. ..... 315/299
8,035,606 B2 * 10/2011 Liao et al. ..... 345/102
2007/0096868 A1 5/2007 Bauchot et al.
2007/0195025 A1 8/2007 Korcharz et al.
2008/0094349 A1 4/2008 Liao et al.
2009/0128053 A1 5/2009 Dhayagude et al.
2009/0230882 A1 9/2009 Santo et al.

FOREIGN PATENT DOCUMENTS

WO 2007/096868 A1 8/2007

OTHER PUBLICATIONS

International Search Report for Parallel PCT Application PCT/US2010/051024—European Patent Office Dec. 13, 2010.
Written Opinion of the International Searching Authority for Parallel PCT Application PCT/US2010/051024—European Patent Office Dec. 13, 2010.

* cited by examiner

*Primary Examiner* — Minh D A
(74) *Attorney, Agent, or Firm* — Simon Kahn

(57) ABSTRACT

A backlight system for light emitting diodes (LEDs), the backlight system constituted of: a controllable power source; a plurality of LED based luminaires arranged to receive power in parallel from the controllable power source; a plurality of driving circuitries, each of the plurality of driving circuitries arranged to control the light output of at least two of the plurality of LED based luminaires and further arranged to output information regarding the voltage drop of at least one of the at least two LED based luminaires controlled thereby, wherein the controllable power source is arranged to output a voltage whose value is responsive to the output information.

15 Claims, 5 Drawing Sheets

DISTRIBUTED ARCHITECTURE VOLTAGE CONTROLLED BACKLIGHT DRIVER

BACKGROUND OF THE INVENTION

The present invention relates to the field of light emitting diode based lighting and more particularly to a distributed architecture for driving and controlling a plurality of LED strings having a single controllable power source.

Light emitting diodes (LEDs) and in particular high intensity and medium intensity LED strings are rapidly coming into wide use for lighting applications. LEDs with an overall high luminance are useful in a number of applications including, but not limited to, backlighting for liquid crystal display (LCD) based monitors and televisions, collectively hereinafter referred to as a monitor. In a large LCD monitor the LEDs are typically supplied in one or more strings of serially connected LEDs, thus sharing a common current.

In order supply a white backlight for the monitor, one of two basic techniques is commonly used. In a first technique one or more strings of "white" LEDs are utilized, the white LEDs typically comprising a blue LED with a phosphor which absorbs the blue light emitted by the blue LED and emits a white light. In a second technique one or more individual strings of colored LEDs are placed in proximity so that in combination their light is seen as a white light. Often, two strings of green LEDs are utilized to balance one string each of red and blue LEDs.

In either of the two techniques, the strings of LEDs are in one embodiment located at one end or one side of the monitor, the light being diffused to appear behind the LCD by a diffuser. In another embodiment the LEDs are located directly behind the LCD, the light being diffused by a diffuser so as to avoid hot spots. In the case of colored LEDs, a further mixer is required, which may be part of the diffuser, to ensure that the light of the colored LEDs are not viewed separately, but are rather mixed to give a white light. The white point of the light is an important factor to control, and much effort in design and manufacturing is centered on the need for a controlled white point.

Each of the LED strings is typically controlled by one of amplitude modulation (AM) and pulse width modulation (PWM) to achieve an overall fixed perceived luminance and, in the event of colored LEDs, color balance.

Each of the LED strings has a voltage requirement associated with the forward voltage drop of the constituent LEDs and the number of LEDs in the LED string. As the LED strings age, their voltage drops change, and furthermore, the voltage drops of the LED strings change as a function of temperature. In order to accommodate these requirements, the voltage output of the power source supplying power to a connected LED string must initially be set high enough so as to supply sufficient voltage over the operational life of the LED string taking into account a range of operating temperatures.

Ideally, separate power sources are supplied for each LED string, the power sources being set to exhibit a voltage output in line with the voltage drop across the associated LED string. Such a large plurality of power sources effectively minimizes excess power dissipation however the requirement for a large plurality of power sources is costly.

An alternative solution, which reduces the number of power sources required, is to supply a single power source for a plurality of LED strings. Unfortunately, since as indicated above different LED strings exhibit different voltage drops, such a solution further requires an active element in series with each LED string to compensate for the different voltage drops so as to ensure an essentially equal current through each of the LED strings of the same color connected to the single power source.

Utilizing a single fixed voltage power source for a plurality of LED strings thus results in excess power dissipation, as the power source is set to supply a sufficient voltage for all the LED strings over their operational life, which must be dissipated for LED strings exhibiting a lower voltage drop.

U.S. Patent Application Publication S/N US 2007/0195025A1 published Aug. 23, 2007 to Korcharz et al., entitled "Voltage Controlled Backlight Driver", the entire contents of which is incorporated herein by reference, is addressed to a system for powering and controlling an LED backlight constituted of a plurality of LED strings receiving power from a single controllable power source. A control circuitry is operative to control the output voltage of the controllable power source responsive to an electrical characteristic of at least one of the plurality of LED strings.

The above solution provides a plurality of choices for closing the loop between an electrical characteristic, such as a voltage drop, of at least one of the plurality of LED strings, and a controllable power source. As the size of monitors grow the need for more and more LED strings is rapidly being foreseen. The solutions afforded by the above application are best suited to use in a single control circuitry, and thus are not suitable for large layouts where multiple control circuitry chips are required, each of the multiple control circuitry chips controlling a plurality of LED strings, where the multiple control circuitry chips and their associated pluralities of LED strings are arranged to operate in cooperation with a single controllable power source.

SUMMARY OF THE INVENTION

Accordingly, it is a principal object of the present invention to overcome the disadvantages of prior art. This is provided in the present invention by a backlight system exhibiting a plurality of driving circuitries, each associated with at least two LED based luminaires all connected in parallel to a single controllable power source. A distributed architecture is provided, wherein in one embodiment a single one of the driving circuitries acts as a master, and the other driving circuitries act as slaves. There is no requirement that the master driving circuitry be associated with one or more LED based luminaires, and in an alternative embodiment all the LED based luminaire are controlled by slave control circuitries.

Each of the driving circuitries are arranged to monitor at least one electrical characteristic of the LED based luminaires driven by the slave driving circuitry, determine the LED based luminaires exhibiting the at least one electrical characteristic for which the controllable power source is to be controlled, and output information regarding the at least one electrical characteristic of the determined LED based luminaires to the master driving circuitry. In an exemplary embodiment the output information is a function of the voltage drop of the LED based luminaires. In one particular embodiment, in which a dissipative element is provided at the low side of the LED based luminaires, and the dissipative element is implemented in an FET, the drain voltage of the LED based luminaires exhibiting the greatest voltage drop, i.e. the lowest drain voltage, associated with the driving circuitry, is output.

In one embodiment the driving circuitries are serially connected, and the output information reflects the LED based luminaires driven thereby in relation to the input information received from a serially connected driving circuitry, with the controllable power source responsive to the ultimate driving circuitry. In another embodiment the output information is connected in parallel to the driving circuitry.

Independently, the backlight system comprises: a controllable power source; a plurality of LED based luminaires arranged to receive power in parallel from the controllable power source; a plurality of driving circuitries, each of the plurality of driving circuitries arranged to control the light output of at least two of the plurality of LED based luminaires and further arranged to output information regarding the voltage drop of at least one of the at least two LED based luminaires controlled thereby, wherein the controllable power source is arranged to output a voltage responsive to the output information and wherein the plurality of driving circuitries are either: connected in series, the output information of each driving circuitry comprises information regarding the voltage drop of at least one of the at least two LED based luminaires controlled thereby in relation to the output information received from a preceding serially connected driving circuitry; or the output information from the plurality of driving circuitries is connected in parallel to the controllable power source.

In one embodiment each of the plurality of LED based luminaires is constituted of an LED string. In another embodiment when the plurality of driving circuitries is connected in series the controllable power source is responsive to the output of the ultimate of the serially connected plurality of driving circuitries.

In one embodiment the backlight system further comprises a plurality of controllable dissipative elements, each of the plurality of controllable dissipative elements arranged in series with a unique one of the plurality of LED based luminaires, and wherein the output information is a function of the voltage at one end of the respective controllable dissipative element. In one further embodiment each of the driving circuitries comprises a monitoring and control functionality arranged to: detect if any of the at least two LED based luminaires controlled thereby are inactive; and prevent the output information from reflecting the function of the voltage of the respective controllable dissipative element arranged in series with the inactive LED based luminaire controlled thereby.

In one yet further embodiment the monitoring and control functionality is further operative to: compare an electrical characteristic of each of the at least two LED based luminaires controlled thereby when the LED based luminaire is in an active state with the electrical characteristic of the LED based luminaire in an inactive state; and prevent, in the event that the electrical characteristic of one of the LED based luminaires controlled thereby is unchanged between the active and inactive states, the output information from reflecting the function of the voltage of the respective controllable dissipative element arranged in series with the unchanging LED based luminaire controlled thereby. In another yet further embodiment the monitoring and control functionality is further operative to: detect if any of the at least two LED based luminaires controlled thereby are active at a duty cycle in excess of a predetermined value, denoted a high duty cycle; interrupt the operation of the high duty cycle LED based luminaire to create an inactive state for the high duty cycle LED based luminaire; compare the electrical characteristic of the high duty cycle LED based luminaire when the high duty cycle LED based luminaire is in an active state with the electrical characteristic of the high duty cycle LED based luminaire in the created inactive state; and prevent, in the event that the electrical characteristic of the high duty cycle LED based luminaire is unchanged between the active and inactive states, the output information from reflecting the function of the voltage of the respective controllable dissipative element arranged in series with the unchanging high duty cycle LED based luminaire controlled thereby.

In one embodiment the backlight system further comprises a single dimming input signal, each of the plurality of driving circuitries arranged to control the respective at least two LED based luminaires responsive to the single dimming input signal. In another embodiment the backlight system further comprises a plurality of dimming input signals, each of the plurality of dimming input signals associated with a particular one of the plurality of LED based luminaires, each of the plurality of driving circuitries responsive to the dimming input signals associated with the respective LED based luminaires controlled thereby.

Independently, a method of controlling a backlight system for light emitting diodes (LEDs) is provided, the method comprising: providing a controllable power source; providing a plurality of LED based luminaires each arranged to receive power in parallel from the provided controllable power; providing a plurality of driving circuitries each arranged to control at least two of the provided LED based luminaires; outputting information from each of the provided plurality of driving circuitries regarding an electrical characteristic of at least one of the at least two LED based luminaires controlled thereby; connecting the output information from the provided plurality of driving circuitries in parallel to the controllable power source; and controlling the output voltage of the provided controllable power source responsive to the parallel connected output information.

In one embodiment each of the provided plurality of LED based luminaires is constituted of an LED string. In another embodiment the method further comprises: detecting if any of the LED based luminaires are inactive; and preventing the output information from reflecting the electrical characteristic of the detected inactive LED based luminaire.

In one embodiment the method further comprises: comparing the electrical characteristic of each of the plurality of LED based luminaires when in an active state with the electrical characteristic of the LED based luminaire in an inactive state; and preventing, in the event that the electrical characteristic of one of the LED based luminaires is unchanged between the active and inactive states, the output information from reflecting the electrical characteristic of the unchanging LED based luminaire. In another embodiment the method further comprises: detecting if any of the LED based luminaires are active at a duty cycle in excess of a predetermined value, denoted a high duty cycle; interrupting the operation of the high duty cycle LED based luminaire to create an inactive state for the high duty cycle LED based luminaire; comparing the electrical characteristic of the high duty cycle LED based luminaire in the created inactive state with the electrical characteristic of the high duty cycle LED based luminaire in the active state; and preventing, in the event that the electrical characteristic of the high duty cycle LED based luminaire is unchanged between the active and created inactive states, the output information from reflecting the electrical characteristic of the unchanging high duty cycle LED based luminaire.

In one embodiment the method further comprises: controlling the provided plurality of LED based luminaires responsive to a single dimming input signal. In another embodiment the method further comprises: controlling each of the provided LED based luminaires responsive to a respective unique dimming input signal.

Independently, a method of controlling a backlight system for light emitting diodes (LEDs) is provided, the method comprising: providing a controllable power source; providing a plurality of LED based luminaires each arranged to receive power in parallel from the provided controllable power source; providing a plurality of driving circuitries each arranged to control at least two of the provided LED based luminaires; outputting information from each of the provided plurality of driving circuitries regarding an electrical characteristic of at least one of the at least two LED based luminaires controlled thereby; connecting the output information from the provided plurality of driving circuitries in series, and wherein the output information of each driving circuitry comprises information regarding the electrical characteristic of at least one of the at least two LED based luminaires controlled thereby in relation to the output information received from a preceding serially connected driving circuitry; and controlling the output voltage of the provided controllable power source responsive to the serially connected output information.

In one embodiment the controlling of the output voltage of the provided controllable power source is responsive to the output information of the ultimate of the serially connected provided plurality of driving circuitries. In another embodiment the method further comprises: detecting if any of the LED based luminaires are inactive; and preventing the output information from reflecting the electrical characteristic of the detected inactive LED based luminaire.

In one embodiment the method further comprises: comparing the electrical characteristic of each of the plurality of LED based luminaires when in an active state with the electrical characteristic of the LED based luminaire in an inactive state; and preventing, in the event that the electrical characteristic of one of the LED based luminaires is unchanged between the active and inactive states, the output information from reflecting the electrical characteristic of the unchanging LED based luminaire. In another embodiment the method further comprises: detecting if any of the LED based luminaires are active at a duty cycle in excess of a predetermined value, denoted a high duty cycle; interrupting the operation of the high duty cycle LED based luminaire to create an inactive state for the high duty cycle LED based luminaire; comparing the electrical characteristic of the high duty cycle LED based luminaire in the created inactive state with the electrical characteristic of the high duty cycle LED based luminaire in the active state; and preventing, in the event that the electrical characteristic of the high duty cycle LED based luminaire is unchanged between the active and created inactive states, the output information from reflecting the electrical characteristic of the unchanging high duty cycle LED based luminaire.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1:
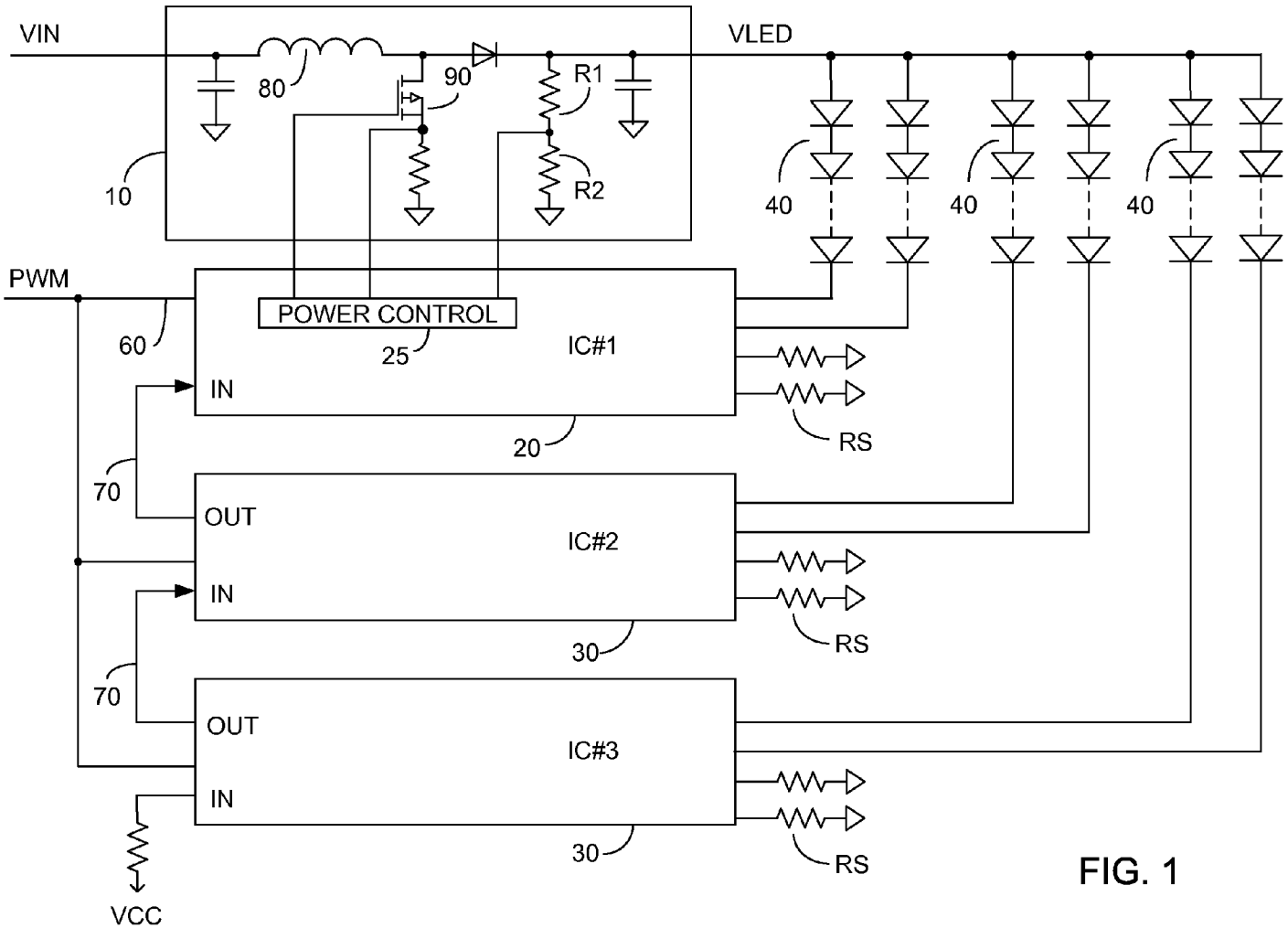
FIG. 1 illustrates a high level block diagram of a backlight system exhibiting a controllable power source and a plurality of series connected driving circuitries, the first driving circuitry arranged to control the output of the controllable power source and each of the driving circuitries receiving a single common dimming input.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 illustrates a high level block diagram of an exemplary embodiment of a backlight system comprising: a controllable power source 10; a plurality of LED based luminaires 40, illustrated without limitation as LED strings 40; a power controlling driving circuitry 20 comprising a power control module 25; a plurality of driving circuitries 30; a single dimming input 60 illustrated and denoted without limitation as a PWM input; a plurality of communication channels 70; and a plurality of sense resistors RS. Controllable power source 10 comprises an inductor 80, an electronically controlled switch 90 illustrated without limitation as an NFET, and a pair of resistors R1 and R2. LED based luminaires 40 are arranged to receive in parallel an output of controllable power source 10, denoted VLED, at the anode end thereof. The cathode end of at least two LED based luminaires 40 are connected to power controlling driving circuitry 20 and the cathode end of at least two LED based luminaires 40 are connected to each driving circuitry 30. Each LED based luminaire 40 is associated with a particular sense resistor RS, each illustrated as providing a connection between a respective one of power controlling driving circuitry 20 and a common potential point and driving circuitry 30 and the common potential point. Communication channel 70 is provided between an output of each driving circuitry 30 and the serially connected previous driving circuitry unit, i.e. a second driving circuitry 30 is connected by a communication channel 70 to a first driving circuitry 30, and first driving circuitry 30 is connected via a communication channel 70 to power controlling driving circuitry 20. In one embodiment communication channel 70 is constituted of an analog output, and in another embodiment communication channel 70 is constituted of a digital communication channel. The input of second driving circuitry 30 is connected to a predetermined voltage by a resistor, the voltage denoted VCC.

Power controlling driving circuitry 20 and each driving circuitry 30 are illustrated as having controllable dissipative elements internal thereto, as will be described further hereinto below, wherein each controllable dissipative element is associated with a particular LED based luminaire 40 and respective associated sense resistor RS, however this is not meant to be limiting in any way and external controllable dissipative elements may be supplied without exceeding the scope.

An input capacitor is connected between a source of DC power, denoted VIN, and a common potential, and source of DC power VIN is further connected to a first end of inductor 80. A second end of inductor 80 is connected via a unidirectional electronic valve to output VLED, which as indicated above is connected to the anode end of each of the LED based luminaires 40. An output capacitor is further provided connected between output VLED and the common potential. The drain of electronically controlled switch 90 is connected to the second end of inductor 80, the source of electronic controlled switch 90 is connected to the common potential via a resistor and the gate of electronically controlled switch 90 is connected to an output of power controlling driving circuitry 20, particularly to an output of power control module 25. The source of electronically controlled switch 90 is further connected to an input of master driving circuitry 20, particularly to an input of power control module 25. Output VLED is further connected to the common potential via a voltage divider constituted of resistors R1 and R2, the divided voltage connected to an input of master driving circuitry 20, particularly to an input of power control module 25.

Power controlling driving circuitry 20 is illustrated as controlling a plurality of LED based luminaires 40 however this is not meant to be limiting in any way. In another embodiment power controlling driving circuitry 20 is not provided with associated LED based luminaires 40, and power controlling driving circuitry 20 thus functions to control the output of controllable voltage source 10 responsive to the received communication via channel 70. The above is illustrated in an embodiment in which each driving circuitry 30 is provided with a plurality of LED based luminaires 40, however this is not meant to be limiting in any way, and at least one driving circuitry 30 exhibiting only a single LED based luminaire receiving power from controllable power source 10 may be provided, without exceeding the scope. The above is illustrated in an embodiment where two driving circuitries are provided, however this is not meant to be limiting in any way, and any number of driving circuitries 30 may be provided without exceeding the scope.

In operation, controllable power source 10 produces output voltage VLED from input voltage VIN responsive to the alternate opening and closing of electronically controlled switch 90, the alternate opening and closing of electronically controlled switch 90 responsive to power control module 25 of power controlling driving circuitry 20. The duty cycle of electronically controlled switch 90 is controlled by power control module 25 responsive to the electrical characteristics of the various LED based luminaires 40 as will be described further hereinto below and responsive to dimming input 60. The output of controllable power source 10 is further sampled by the voltage divider constituted of resistors R1 and R2, the divided sample voltage fed as an input to power control module 25.

Each driving circuitry 30 is operative to monitor at least one electrical characteristic of the plurality of LED based luminaires 40 associated therewith and driven thereby, determine the particular one of the plurality of LED based luminaires 40 exhibiting the at least one electrical characteristic for which controllable power source 10 is preferably to be controlled, and output information regarding the at least one electrical characteristic of the determined particular one of the plurality of LED based luminaires 40 via channel 70. As described above the driving circuitries 20, 30 are connected in series, and thus the input of second driving circuitry 30 is connected to a predetermined potential. The output of second driving circuitry 30 is connected to the input of the preceding driving circuitry 30, where the receiving information is compared to the determined electrical characteristic. In one particular embodiment as illustrated, in which a dissipative element is provided at the low side of each of the LED based luminaires 40, and the dissipative element is implemented in an FET, information regarding the lowest drain voltage of the dissipative element associated with the plurality of LED based luminaires 40 responsive thereto is output for transmission via communication channel 70. In an exemplary embodiment, as will be described further hereinto below, the information regarding the lowest drain voltage, or other electrical characteristic, is further filtered so as to account for a disabled or open LED based luminaire 40. There is no requirement that identification of the particular LED based luminaire 40 be passed, or that the particular LED based luminaire 40 be directly identified. Transmission of information regarding the electrical characteristic is sufficient. In an exemplary embodiment, the input received via communication channel 70 is added to the comparison. Thus, if the lowest voltage is represented by the value received via communication channel 70 from the preceding driving circuitry 30, the lowest voltage received via communication channel 70 is further output via the output port of the driving circuitry 30.

Power controlling driving circuitry 20 is arranged to monitor at least one electrical characteristic of the plurality of LED based luminaires 40 associated therewith and driven thereby and determine the particular one of the LED based luminaires 40 responsive thereto for which controllable power source 10 is preferably to be controlled, particularly in comparison to the information received from communication channel 70. Thus, power controlling driving circuitry 20 is arranged to determine whether the determined one of the LED based luminaires 40 associated therewith is to be utilized to control the output of controllable power source 10, or whether a value received via communication channel 70 is to be utilized to control the output of controllable power source 10, thus effectively controlling output VLED responsive to an electrical characteristic of any of the LED based luminaires 40, without limitation.

There is no requirement that power controlling driving circuitry 20 actually identify the LED based luminaire 40 associated therewith exhibiting the controlling electrical characteristic, since in an exemplary embodiment control of output VLED is responsive to the electrical characteristic itself and not a function of a particular identification. Thus in one non-limiting embodiment the electrical characteristics of each LED based luminaire 40, whether associated with power controlling driving circuitry 20 or driving circuitry 30 is connected to a circuitry arranged to pass a minimum value of the plurality of inputs towards power control module 25 so as to control output VLED without exceeding the scope.

In one non-limiting embodiment, as described above, power controlling driving circuitry 20 is arranged to control output VLED of controllable power source 10 so as to minimize the lowest drain voltage of the plurality of dissipative elements each associated with a particular LED based luminaire 40, irrespective of whether the lowest drain voltage is associated with power controlling driving circuitry 20 or with one of the various driving circuitries 30. Preferably, a minimum head room is determined so that the lowest drain voltage is not allowed to fall below a predetermined value. The predetermined value may be associated with an error condition as described further hereinto below.

In an exemplary embodiment, each of power controlling driving circuitry 20 and driving circuitries 30 is further operative to determine that the electrical characteristic is within a predetermined range indicative of proper operation of the respective LED based luminaire 40, and if the characteristic is outside of the predetermined range, not use the electrical characteristic of the LED based luminaire 40 to control output VLED of controllable power source 10. Thus in the event of an LED based luminaire 40 exhibiting an open LED, or one or more shorted LEDs, the LED based luminaire 40 exhibiting the open LED or shorted LED or LEDs will not be used to control output VLED of controllable power source 10, irrespective of the electrical characteristic, and may be further disabled.

In one embodiment, in the event that the electrical characteristic utilized to control output VLED of controllable power source 10 is outside of a predetermined range, the response rate of controllable power source 10 is preferably accelerated. In a non-limiting example, in the event that the drain voltage of a dissipative element is utilized to control output VLED of controllable power source 10, in the event that the lowest drain voltage associated with the various LED based luminaires 40 exceeds a first pre-determined limit, the response rate of controllable power source 10 is preferably accelerated to rapidly reduce excess power dissipation, and in the event that the lowest drain voltage associated with the various LED based luminaires 40 is less than a second pre-determined limit, the response rate of controllable power source 10 is preferably accelerated to rapidly overcome current starvation.

Figure 2:
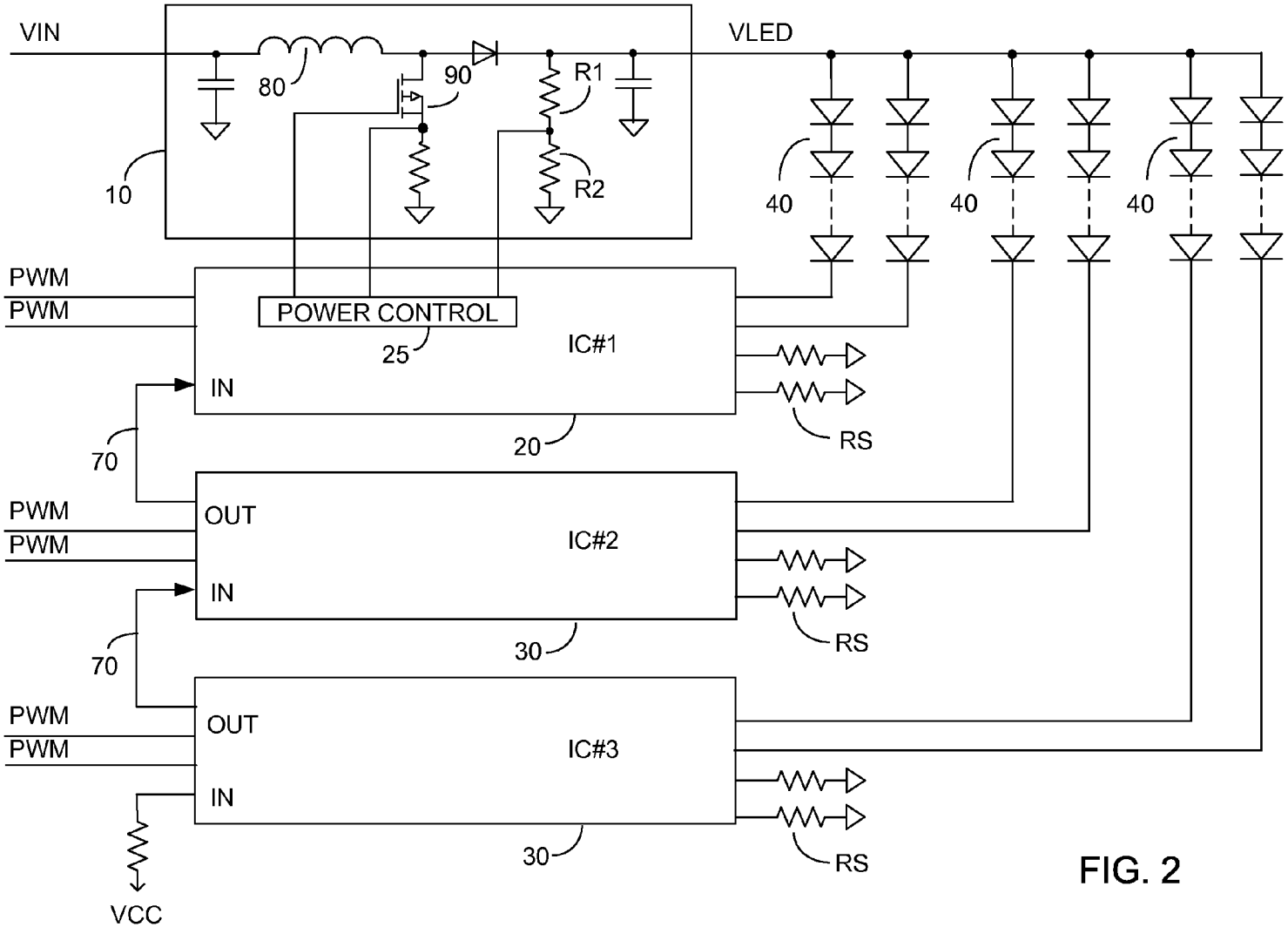
FIG. 2 illustrates a high level block diagram of a backlight system exhibiting a controllable power source and a plurality of series connected driving circuitries, the first driving circuitry arranged to control the output of the controllable power source and each of the driving circuitries receiving a dimming input for each LED based luminaire.

FIG. 2 illustrates a high level block diagram of a backlight system exhibiting a controllable power source 10 and a plurality of series connected driving circuitries, as described above in relation to FIG. 1, with the exception that a unique dimming input is supplied for each LED based luminaire 40, in place of single diming input 60. In operation, FIG. 2 is in all respects similar to FIG. 1, with the exception that a plurality of PWM lines, representing dimming, are provided from a video controller (not shown), each PWM line associated with a particular LED based luminaire 40, or a group of LED based luminaires 40.

It is to be understood that measurement of the at least one electrical characteristic must be coordinated with the respective PWM signal to ensure that the electrical characteristic is measured, or sampled, only during an active period, and further that any comparison of electrical characteristics measured or sampled must be valid during the comparison.

Preferably, EMI and voltage ripple are reduced by appropriate staggering of the operation of each of the LED based luminaires 40 responsive to the timing of the respective PWM inputs. Alternatively, staggering is provided responsive to commands received from the master driving circuitry.

Figure 3:
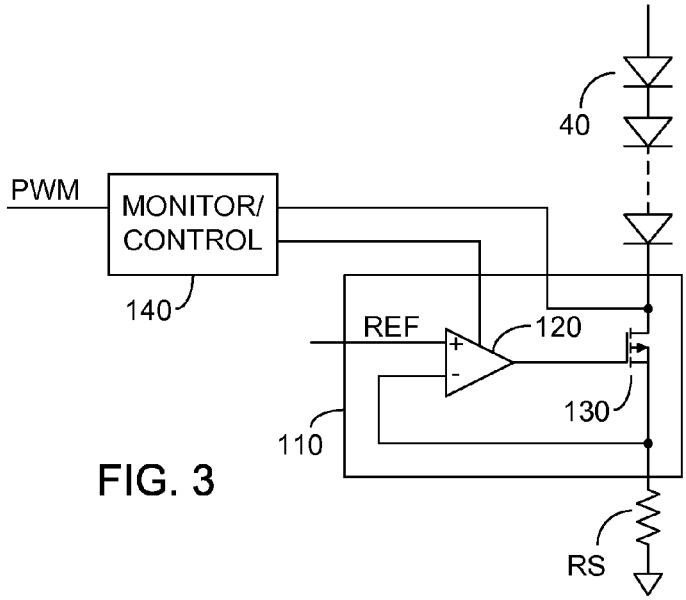
FIG. 3 illustrates a high level schematic diagram of a controlled dissipative element preferably provided associated with each LED based luminaire of FIG. 1 or FIG. 2.

FIG. 3 illustrates a high level schematic diagram of a controlled dissipative element 110 provided associated with each LED based luminaire 40 in both power controlling driving circuitry 20 and driving circuitry 30 comprising a differential amplifier 120 and an electronically controlled switch 130, illustrated without limitation as an NMOSFET. Each controlled dissipative element is responsive to a single monitoring and control functionality 140, as will be described further hereinto below. For clarity LED based luminaire 40 and sense resistor RS, described above in relation to FIG. 1 and FIG. 2 are further illustrated.

The cathode end of LED based luminaire 40 is connected to the drain of electronically controlled switch 130 and to an input of monitoring and control functionality 140. The source of electronically controlled switch 130 is connected to the inverting input of differential amplifier 120 and via sense resistor RS to the common potential. The non-inverting input of differential amplifier 120 is connected to a reference voltage signal, denoted REF, the control input of differential amplifier 120 is connected to an output of monitoring and control functionality 130 and the output of differential amplifier 120 is connected to the gate of electronically controlled switch 130. A PWM control input for each LED based luminaire 40 as described above in relation to FIG. 2, or a single PWM input 60 for all LED based luminaires 40, as described above in relation to FIG. 1, is connected as an input to monitoring and control functionality 130.

In operation, controlled dissipative element 110 acts to limit the current through LED based luminaire 40 so as not to exceed the value represented by reference voltage REF. Monitoring and control functionality 140 is operative to place LED based luminaire 40 alternately in an active state by enabling differential amplifier 120 and in an inactive state by disabling differential amplifier 120. Monitoring and control functionality 140 is further active to input the drain voltage of each electronically controlled switch 130 when the respective LED based luminaire 40 is in an active state, and compare the various input drain voltages of the various electronically controlled switches 130 to determine the LED based luminaire 40 exhibiting the greatest voltage drop. In an exemplary embodiment, the lowest drain voltage of the plurality of electronically controlled switches 130 is communicated via communication channel 70 to power controlling driving circuitry 20. In one particular embodiment, the input received via communication channel 70 is provided as an additional input to monitoring and control functionality 140. The output of monitoring and control functionality 140 of power controlling driving circuitry 20 is fed as an input to power control module 25 to control output voltage VLED responsive thereto.

Monitoring and control functionality 140 is further operative to compare the voltage at the drain of electronically controlled switch 130 when the associated LED based luminaire 40 is in an active state with the voltage at the drain of electronically controlled switch 130 when the associated LED based luminaire 40 is in an inactive state. In the event that the voltage is unchanged, or changed by an amount less than a predetermined minimum, indicative that LED based luminaire 40 is open, the drain voltage associated with unchanging LED based luminaire 40 is not utilized in determining the lowest drain voltage, thus preventing power control module 25 from controlling output VLED responsive to the unchanging LED based luminaire 40.

Monitoring and control functionality 140 is further operative in the event that an LED based luminaire 40 exhibits a duty cycle greater than a predetermined value, the LED based luminaire 40 thus denoted a high duty cycle LED based luminaire 40, to interrupt the duty cycle, thus putting the high duty cycle LED based luminaire 40 into an inactive state. Monitoring and control functionality 140 is further operative to compare the voltage at the drain of electronically controlled switch 130 when the associated high duty cycle LED based luminaire 40 is in an active state with the voltage at the drain of electronically controlled switch 130 when the associated high duty cycle LED based luminaire 40 is in an inactive state. In the event that the voltage is unchanged, or changed by an amount less than a predetermined minimum, indicative that the high duty cycle LED based luminaire 40 is open, the drain voltage associated with unchanging high duty cycle LED based luminaire 40 is not utilized in determining the lowest drain voltage, thus preventing power controlling driving circuitry 20 from controlling output VLED responsive to the unchanging high duty cycle LED based luminaire 40.

Monitoring and control functionality 140 is further operative to ensure that comparison of the respective voltages is performed only on drain voltages when the associated LED based luminaire 40 is an active state, and thus in an exemplary embodiment comprises a memory, or sample and hold functionality, since there is no requirement that all LED strings 40 be in an active state contemporaneously.

Figure 4:
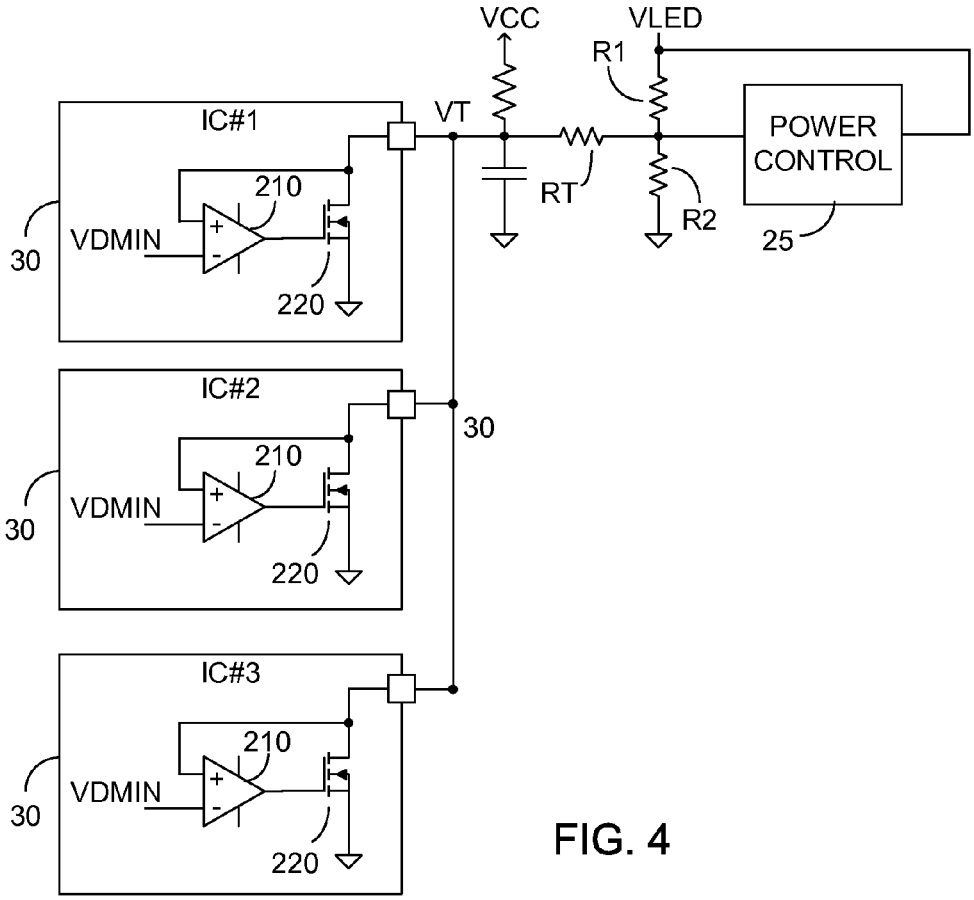
FIG. 4 illustrates a high level schematic diagram of a parallel connected plurality of driving circuitries.

FIG. 4 illustrates a high level schematic diagram of a parallel connected plurality of driving circuitries 30, comprising power control module 25, resistors R1 and R2, and a linking resistor RT. Each driving circuitry 30 comprises a differential amplifier 210 and an electronically controlled switch 220, illustrated without limitation as an NFET. The inverting input of each differential amplifier 210 is connected to the output identified electrical characteristic of the respective monitoring and control functionality 140, illustrated herein as VDMIN, i.e. the minimum drain voltage of the associated dissipative elements as described above in relation to FIG. 3, particularly electronically controlled switch 130. The output of each differential amplifier 210 is connected to the gate of the respective electronically controlled switch 220, the source of each of the electronically controlled switches 220 are connected to the common potential and the drain of each electronically controlled switch 220 is connected to the non-inverting input of the respective differential amplifier 210 and to a first end of linking resistor RT, the potential denoted VT. The first end of linking resistor RT is further connected to a positive potential, denoted VCC, by a resistor and to the common potential by a capacitor. A second end of linking resistor RT is connected to the common point of resistors R1 and R2 and to the feedback input of power control module 25, as described above in relation to FIG. 1.

In operation, each differential amplifier 210 is operative to drive potential VT to be no greater than the respective VDMIN input at the inverting input of the differential amplifier 210 by controlling the gate voltage of the respective electronically controlled switch 220, while allowing potential VT to be reduced to a lower value than VDMIN without reaction. Thus, potential VT reflects the lowest of the various VDMIN values experienced at the inverting inputs of the respective differential amplifiers 210. Feedback voltage via the resistor divider constituted of R1 and R2 is impacted by potential VT, particularly VLED is controlled by the equation:

$$VLED=Vref*(1+R1/R2)-R1/RT(VT-Vref),$$

Wherein Vref is an internal reference for an error amplifier of power control module 25.

Figure 5:
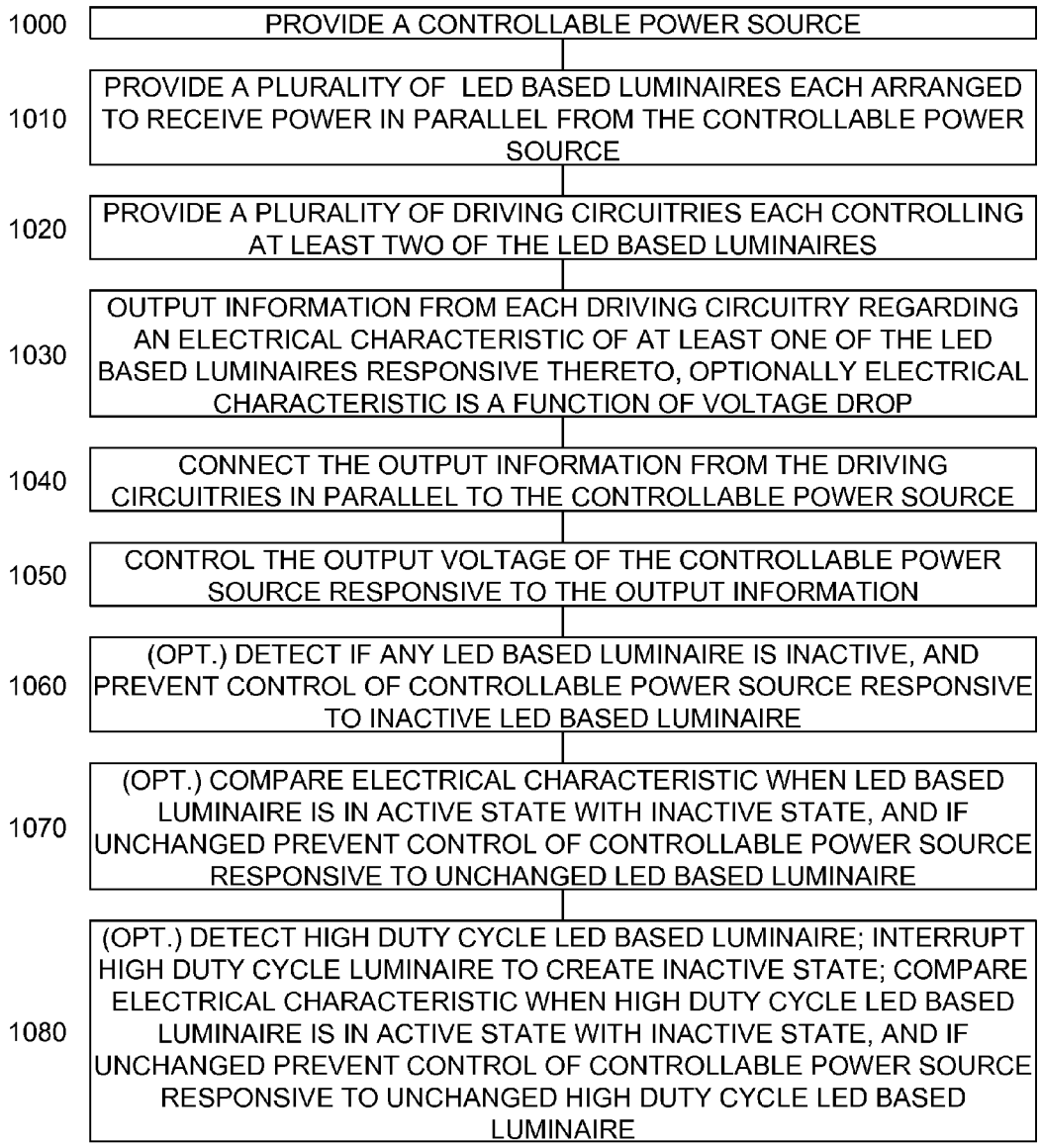
FIG. 5 illustrates a high level flow chart of an exemplary embodiment of a method of operation suitable for use with the backlight system of FIG. 4.

FIG. 5 illustrates a high level flow chart of an exemplary embodiment of a method of operation suitable for use with the backlight system of FIG. 4. In stage 1000 a controllable power source is provided. In stage 1010 a plurality of LED based luminaires are provided each arranged to receive power in parallel from the provided controllable power source of stage 1000. In stage 1020 a plurality of driving circuitries are provided, each provided driving circuitry controlling at least two of the provided LED based luminaires of stage 1010. In stage 1030 information is output from each driving circuitry regarding an electrical characteristic of at least one of the LED based luminaires responsive to the respective driving circuitry. Optionally the electrical characteristic is a function of voltage drop across the LED based luminaires responsive to the respective driving circuitry. In one particular embodiment where a dissipative element is supplied for each LED based luminaire at the low side of the luminaire, as described in relation to FIG. 3, the electrical characteristic is the lowest voltage at the drain of the dissipative element of a properly acting LED based luminaire. In stage 1040 the output information from the various driving circuitries are connected to the controllable power source of stage 1000 in parallel, as described above in relation to FIG. 4.

In stage 1050, the output voltage of the provided controllable power source of stage 1000 is controlled responsive to the output information. In particular, in an exemplary embodiment the output voltage of the provided controllable power source of stage 1000 is preferably controlled responsive to the LED based luminaire exhibiting the greatest voltage drop, irrespective of the respective driving circuitry associated therewith.

In optional stage 1060, detection that any of the LED based luminaires is inactive is performed, and control of the output voltage of the controllable power source of stage 1050 responsive to the inactive LED base luminaire is prevented, preferably by preventing the output of information from reflecting the inactive LED based luminaire.

In optional stage 1070, the electrical characteristic of each of the LED based luminaires in the active state are compared with the electrical characteristic of the LED based luminaire in the inactive state. If the electrical characteristic is unchanged, this is indicative of a failed LED based luminaire, and control of the output voltage of the controllable power source of stage 1050 responsive to the unchanging LED base luminaire is prevented, preferably by preventing the output of information from reflecting the unchanging LED based luminaire.

In optional stage 1080, an LED based luminaire exhibiting a duty cycle in excess of a predetermined limit is detected, and denoted a high duty cycle LED based luminaire, wherein the high duty cycle is determined responsive to the associated dimming signal. The high duty cycle is interrupted to create an inactive state for the high duty cycle LED based luminaire. Interruption may be required due to: a 100% duty cycle; the high duty cycle exceeding other required response parameters; or for other requirements without limitation. The electrical characteristic of the high duty cycle LED based luminaire in the active state is compared with the electrical characteristic of the high duty cycle LED based luminaire in the inactive state. If the electrical characteristic is unchanged, this is indicative of a failed high duty cycle LED based luminaire, and control of the output voltage of the controllable power source of stage 1050 responsive to the unchanging high duty cycle LED base luminaire is prevented, preferably by preventing the output of information from reflecting the unchanging high duty cycle LED based luminaire.

Figure 6:
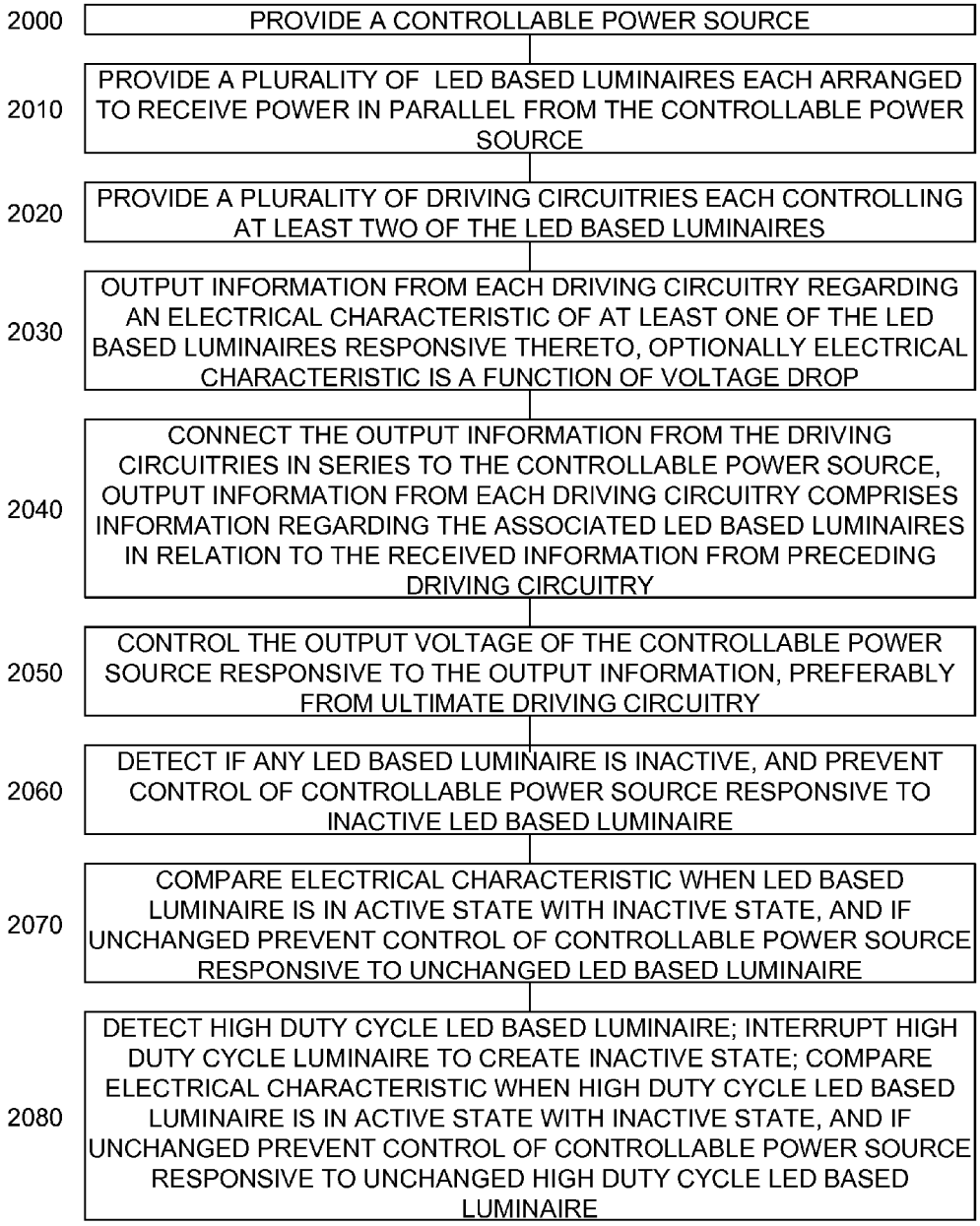
FIG. 6 illustrates a high level flow chart of an exemplary embodiment of a method of operation suitable for use with the driving circuitries of either FIG. 1 or FIG. 2.

FIG. 6 illustrates a high level flow chart of an exemplary embodiment of a method of operation suitable for use with the backlight system of either FIG. 1 or FIG. 2. In stage 2000 a controllable power source is provided. In stage 2010 a plurality of LED based luminaires are provided each arranged to receive power in parallel from the provided controllable power source of stage 2000. In stage 2020 a plurality of driving circuitries are provided, each provided driving circuitry controlling at least two of the provided LED based luminaires of stage 2010. In stage 2030 information is output from each driving circuitry regarding an electrical characteristic of at least one of the LED based luminaires responsive to the respective driving circuitry. Optionally the electrical characteristic is a function of voltage drop across the LED based luminaires responsive to the respective driving circuitry. In one particular embodiment where a dissipative element is supplied for each LED based luminaire at the low side of the luminaire, as described in relation to FIG. 3, the electrical characteristic is the lowest voltage at the drain of the dissipative element of a properly acting LED based luminaire. In stage 2040 the output information from the various driving circuitries are connected to the controllable power source of stage 2000 in series, as described above in relation to FIG. 1 and FIG. 2. In an exemplary embodiment output information from each driving circuitry thus comprises information regarding the electrical characteristic of the LED based luminaires responsive to the driving circuitry in relation to the received information from the previous one of the serially connected driving circuitries. In one embodiment, in the event that a minimum voltage is passed, the circuitry of FIG. 3 may be used internally within driving circuitry 30 or power controlling driving circuitry 20, with the respective drain voltages of the associated LED based luminaires connected as VDMIN, and the received minimum voltage connected as an additional VDMIN.

In stage 2050, the output voltage of the provided controllable power source of stage 2000 is controlled responsive to the output information. In particular, in an exemplary embodiment the output voltage of the provided controllable power source of stage 2000 is preferably controlled responsive to the LED based luminaire exhibiting the greatest voltage drop, irrespective of the respective driving circuitry associated therewith. Preferably, the controllable power source is controlled by the ultimate of the serially connected driving circuitries, such as power controlling driving circuitry 20 of FIG. 1 or FIG. 2.

In optional stage 2060, detection that any of the LED based luminaires is inactive is performed, and control of the output voltage of the controllable power source of stage 2050 responsive to the inactive LED base luminaire is prevented, preferably by preventing the output of information from reflecting the inactive LED based luminaire.

In optional stage 2070, the electrical characteristic of each of the LED based luminaires in the active state are compared with the electrical characteristic of the LED based luminaire in the inactive state. If the electrical characteristic is unchanged, this is indicative of a failed LED based luminaire, and control of the output voltage of the controllable power source of stage 2050 responsive to the unchanging LED base luminaire is prevented, preferably by preventing the output of information from reflecting the unchanging LED based luminaire.

In optional stage 2080, an LED based luminaire exhibiting a duty cycle in excess of a predetermined limit is detected, and denoted a high duty cycle LED based luminaire, wherein the high duty cycle is determined responsive to the associated dimming signal. The high duty cycle is interrupted to create an inactive state for the high duty cycle LED based luminaire. Interruption may be required due to: a 100% duty cycle; the high duty cycle exceeding other required response parameters; or for other requirements without limitation. The electrical characteristic of the high duty cycle LED based luminaire in the active state is compared with the electrical characteristic of the high duty cycle LED based luminaire in the inactive state. If the electrical characteristic is unchanged, this is indicative of a failed high duty cycle LED based luminaire, and control of the output voltage of the controllable power source of stage 2050 responsive to the unchanging high duty cycle LED base luminaire is prevented, preferably by preventing the output of information from reflecting the unchanging high duty cycle LED based luminaire.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable subcombination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and subcombinations of the various features described hereinabove as well as variations and modifications thereof which would occur to persons skilled in the art upon reading the foregoing description and which are not in the prior art.

We claim:

1. A backlight system for light emitting diodes (LEDs), the backlight system comprising:

a controllable power source;

a plurality of LED based luminaires arranged to receive power in parallel from said controllable power source;

a plurality of driving circuitries, each of said plurality of driving circuitries arranged to control the light output of at least two of said plurality of LED based luminaires and further arranged to compare the voltage drops of said controlled at least two LED based luminaires and output information regarding the voltage drop of at least one of said at least two LED based luminaires controlled thereby responsive to said comparison; and a plurality of controllable dissipative elements, each of said plurality of controllable dissipative elements arranged in series with a unique one of said plurality of LED based luminaires, and wherein the output information is a function of the voltage at one end of the respective controllable dissipative element, wherein said controllable power source is arranged to output a voltage responsive to the output information and wherein either:

said plurality of driving circuitries are connected in series, the output information of each driving circuitry comprises information regarding the voltage drop of at least one of said at least two LED based luminaires controlled thereby in relation to the output information received from a preceding serially connected driving circuitry; or the output information from said plurality of driving circuitries is connected in parallel to the controllable power source, wherein each of said plurality of LED based luminaires is constituted of an LED string, wherein each of said driving circuitries comprises a monitoring and control functionality arranged to:

detect if any of the at least two LED based luminaires controlled thereby are inactive; and prevent said output information from reflecting the function of the voltage of the respective controllable dissipative element arranged in series with the inactive LED based luminaire controlled thereby.

2. The backlight system according to claim 1, wherein when the plurality of driving circuitries are connected in series the controllable power source is responsive to the output of the ultimate of said serially connected plurality of driving circuitries.

3. The backlight system according to claim 1, wherein said monitoring and control functionality is further arranged to:

compare an electrical characteristic of each of the at least two LED based luminaires controlled thereby when the LED based luminaire is in an active state with the electrical characteristic of the LED based luminaire in an inactive state; and prevent, in the event that the electrical characteristic of one of the LED based luminaires controlled thereby is unchanged between the active and inactive states, said output information from reflecting the function of the voltage of the respective controllable dissipative element arranged in series with the unchanging LED based luminaire controlled thereby.

4. The backlight system according to claim 1, wherein said monitoring and control functionality is further arranged to:

detect if any of the at least two LED based luminaires controlled thereby are active at a duty cycle in excess of a predetermined value, denoted a high duty cycle;

interrupt the operation of said high duty cycle LED based luminaire to create an inactive state for said high duty cycle LED based luminaire;

compare the electrical characteristic of said high duty cycle LED based luminaire when the high duty cycle LED based luminaire is in an active state with the electrical characteristic of the high duty cycle LED based luminaire in the created inactive state; and prevent, in the event that the electrical characteristic of the high duty cycle LED based luminaire is unchanged between the active and inactive states, said output information from reflecting the function of the voltage of the respective controllable dissipative element arranged in series with the unchanging high duty cycle LED based luminaire controlled thereby.

5. The backlight system according to claim 1, further comprising a single dimming input signal in communication with each of said plurality of driving circuitries, each of said plurality of driving circuitries arranged to control the respective at least two LED based luminaires responsive to said single dimming input signal.

6. The backlight system according to claim 1, further comprising a plurality of dimming input signals, each of said plurality of dimming input signals associated with a particular one of said plurality of LED based luminaires, each of said plurality of driving circuitries responsive to the dimming input signals associated with the respective LED based luminaires controlled thereby.

7. A method of controlling a backlight system for light emitting diodes (LEDs), the method comprising:

providing a controllable power source;

providing a plurality of LED based luminaires each arranged to receive power in parallel from the provided controllable power source;

providing a plurality of driving circuitries each arranged to control at least two of said provided LED based luminaires;

for each of said driving circuitries, comparing an electrical characteristic of each of said at least two of said LED based luminaires controlled by said driving circuitry;

responsive to said comparing, selecting one of said at least two LED based luminaires controlled by said driving circuitry;

outputting information from each of said provided plurality of driving circuitries regarding the electrical characteristic of the selected one LED based luminaire;

connecting the output information from said provided plurality of driving circuitries in parallel to the controllable power source; and controlling the output voltage of said provided controllable power source responsive to said parallel connected output information, wherein each of said provided plurality of LED based luminaires is constituted of an LED string and further comprising: detecting if any of the LED based luminaires are inactive; and preventing said output information from reflecting the electrical characteristic of the detected inactive LED based lurninaire.

8. The method according to claim 5, further comprising:

comparing the electrical characteristic of each of the plurality of LED based luminaires when in an active state with the electrical characteristic of the LED based luminaire in an inactive state; and preventing, in the event that the electrical characteristic of one of the LED based luminaires is unchanged between the active and inactive states, said output information from reflecting the electrical characteristic of the unchanging LED based luminaire.

9. The method according to claim 8, further comprising:

detecting if any of the LED based luminaires are active at a duty cycle in excess of a predetermined value, denoted a high duty cycle;

interrupting the operation of said high duty cycle LED based luminaire to create an inactive state for said high duty cycle LED based luminaire;

comparing the electrical characteristic of said high duty cycle LED based luminaire in the created inactive state with the electrical characteristic of the high duty cycle LED based luminaire in the active state; and preventing, in the event that the electrical characteristic of the high duty cycle LED based luminaire is unchanged between the active and created inactive states, said output information from reflecting the electrical characteristic of the unchanging high duty cycle LED based luminaire.

10. The method according to claim 8, further comprising:

controlling said provided plurality of LED based luminaires responsive to a single dimming input signal in communication with each of said provided plurality of driving circuitries.

11. The method according to claim 8, further comprising:

controlling each of said provided LED based luminaires responsive to a respective unique dimming input signal.

12. A method of controlling a backlight system for light emitting diodes (LEDs), the method comprising:

providing a controllable power source;

providing a plurality of LED based luminaires each arranged to receive power in parallel from the provided controllable power source;

providing a plurality of driving circuitries each arranged to control at least two of said provided LED based luminaires;

for each of said driving circuitries, comparing an electrical characteristic of each of said at least two of said plurality of LED based luminaires controlled by said driving circuitry;

responsive to said comparing, selecting one of said plurality of LED based luminaires controlled by said driving circuitry;

outputting information from each of said provided plurality of driving circuitries regarding the electrical characteristic of the selected one LED based luminaire;

connecting the output information from said provided plurality of driving circuitries in series, wherein the output information of each driving circuitry comprises information regarding the electrical characteristic of the selected one LED based luminaire in relation to the output information received from a preceding serially connected driving circuitry; and controlling the output voltage of said provided controllable power source responsive to said serially connected output information, wherein each of said plurality of LED based luminaires is constituted of an LED string and further comprising: detecting if any of the LED based luminaires are inactive; and preventing said output information from reflecting the electrical characteristic of the detected inactive LED based luminaire.

13. The method according to claim 12, wherein said controlling of the output voltage of said provided controllable power source is responsive to the output information of the ultimate of the serially connected provided plurality of driving circuitries.

14. The method according to claim 13, further comprising:

comparing the electrical characteristic of each of the plurality of LED based luminaires when in an active state with the electrical characteristic of the LED based luminaire in an inactive state; and preventing, in the event that the electrical characteristic of one of the LED based luminaires is unchanged between the active and inactive states, said output information from reflecting the electrical characteristic of the unchanging LED based luminaire.

15. The method according to claim 13, further comprising:

detecting if any of the LED based luminaires are active at a duty cycle in excess of a predetermined value, denoted a high duty cycle;

interrupting the operation of said high duty cycle LED based luminaire to create an inactive state for said high duty cycle LED based luminaire;

comparing the electrical characteristic of said high duty cycle LED based luminaire in the created inactive state with the electrical characteristic of the high duty cycle LED based luminaire in the active state; and preventing, in the event that the electrical characteristic of the high duty cycle LED based luminaire is unchanged between the active and created inactive states, said output information from reflecting the electrical characteristic of the unchanging high duty cycle LED based luminaire.

* * * * *